United States Patent [19]

Nakazawa et al.

[11] 4,226,928

[45] Oct. 7, 1980

[54] LAMINATED PHOTOSENSITIVE MATERIAL FOR ELECTROPHOTOGRAPHY

[75] Inventors: Toru Nakazawa, Osaka; Keiichi Nagahashi, Kaizuka; Tatsuo Aizawa, Osaka, all of Japan

[73] Assignee: Mita Industrial Company, Ltd., Osaka, Japan

[21] Appl. No.: 867,304

[22] Filed: Jan. 5, 1978

[30] Foreign Application Priority Data

Jan. 17, 1977 [JP] Japan ..... 52-2923

[51] Int. Cl.[3] ..... G03G 5/06

[52] U.S. Cl. ..... 430/57; 430/81

[58] Field of Search ..... 430/57, 60, 133, 81

[56] References Cited

U.S. PATENT DOCUMENTS

| | | | |
|---|---|---|---|
| 4,047,948 | 9/1977 | Horgan | 96/1.5 |
| 4,072,520 | 2/1978 | Rochlitz | 96/1.5 |
| 4,106,935 | 8/1978 | Petruzzella | 96/1.5 R |

*Primary Examiner*—Dennis E. Talbert, Jr.

*Assistant Examiner*—John L. Goodrow

*Attorney, Agent, or Firm*—Sherman & Shalloway

[57] ABSTRACT

In a laminated photosensitive material for electrophotography, an intermediate layer comprising, incorporated in a binder, phthalocyanine or a phthalocyanine derivative and a polycyclic aromatic nitro compound at a specific ratio is formed on an electrically conductive substrate, and a top layer comprising an organic polymeric photoconductor and the above polycyclic aromatic nitro compound at a specific ratio is laminated on the intermediate layer. In this photosensitive material, the dark decay speed is controlled in a range suitable for application to the repeated copying operation and the residual potential left on the exposure area can be reduced to a negligible level. Accordingly, occurrence of fogging is prevented and the toner transfer efficiency is improved. Further, this photosensitive material has improved mechanical, chemical and electric durabilities, and therefore, the life of the photosensitive material is remarkably prolonged.

7 Claims, No Drawings

LAMINATED PHOTOSENSITIVE MATERIAL FOR ELECTROPHOTOGRAPHY

BACKGROUND OF THE INVENTION (1) Field of the Invention

This invention relates to a photosensitive material for electrophotography, which has a novel laminate structure. More particularly, the invention relates to a laminated photosensitive material for electrophotography, which comprises an electrically conductive substrate, an intermediate layer formed on the substrate and a top layer laminated on said intermediate layer, wherein the intermediate layer comprises, incorporated in a binder, (A) phthalocyanine or a phthalocyanine derivative and (B) a polycyclic aromatic nitro compound at an (A)/(B) mixing weight ratio of from 10/5 to 10/40 and the top layer comprises (C) an organic polymeric photoconductor and (B) said polycyclic aromatic nitro compound at a (C)/(B) mixing weight ratio of from 6/1 to 1/6.

(2) Description of the Prior Art

In the art of electrophotography, there is broadly adopted a process comprising charging a photosensitive material provided with a photoconductive layer by corona discharge or the like, exposing the photosensitive material imagewise to actinic rays to form an electrostatic latent image on the surface of the photoconductive layer, applying a developer to the surface of the photoconductive layer to form a toner image corresponding to said electrostatic latent image and transferring said toner image formed on the surface of the photoconductive layer onto a copying paper. In this conventional process, after the transfer of the toner image, the photosensitive material is fed to the cleaning step where the residual toner is removed, and it is then fed to the above-mentioned charging step and subsequent steps again.

An electrophotographic photosensitive material that is used repeatedly in the above-mentioned electrophotographic process is required to have some special properties different from properties required of a photosensitive material of the type where a toner is directly fixed on the photosensitive layer. More specifically, in order to prevent fogging in the repeated copying operation and prolong the life of the photosensitive material, it is necessary that the photosensitive material of the former type should have a relatively quick dark decay (the property that the surface potential of the non-exposed area of the photosensitive layer decays relatively quickly in the dark) and a residual potential as low as negligible (the property that the potential left on the exposed area of the photosensitive layer is as low as negligible). When the residual potential of the photosensitive material is high, it already causes fogging at the transfer step. Further, in this case or in the case where the dark decay speed of the photosensitive material is low, electrostatic charges on the electrostatic image formed on the surface of the photosensitive material or electrostatic charges generated for other reason are left on the surface of the photosensitive material even after the transfer and cleaning steps, and they are gradually accumulated and cause fogging at the next cycle of the copying operation. Further, accumulation of charges results in electric deterioration of the photoconductive layer. Moreover, if the dark decay speed is low, even after the transfer step, toner particles are electrostatically attracted to the surface of the photosensitive material by a relatively strong attracting force and therefore, the efficiency of transfer of the toner to a copying paper is relatively low and the surface of the photosensitive material must be wiped strongly to remove the residual toner from the surface of the photosensitive material. As a result, the surface of the photosensitive material is readily and quickly damaged and the life of the photosensitive material is shortened.

The photosensitive material of this repeatedly used type is also required to have a highly enhanced mechanical, electric or chemical durability. Namely, since the photosensitive material of this type undergoes repeatedly the discharge or irradiation treatment and receives repeatedly friction with a magnetic brush or cleaning member, the photoconductive layer of the photosensitive material is readily mechanically damaged or electrically or chemically deteriorated. Moreover, such a trouble as peeling of the photoconductive layer from the electrically conductive substrate is readily caused while the photosensitive material is being used.

As the substance for forming a photoconductive layer of a photosensitive material, there are known various organic and inorganic photoconductors. Among these known photoconductors, phthalocyanine and phthalocyanine derivatives have been noted as substances valuable for manufacture of photosensitive materials for electrophotography because their chemical and electric durabilities are excellent and they are easily available and cheap.

Photosensitive materials for electrophotography including phthalocyanine or its derivative as a photoconductor, however, fail to satisfy the foregoing requirements sufficiently. For example, a photosensitive material comprising a photoconductive layer composed of a dispersion of phthalocyanine or its derivative in an electrically insulating binder, which is formed on an electrically conductive substrate, is still defective in that the value of the surface potential at the charging step is generally low, the rising speed of the surface potential is low, the residual potential at the exposure step is still at a level that cannot be neglected and the speed of reduction of the potential in the non-exposed area, namely the dark decay speed, is low.

BRIEF SUMMARY OF THE INVENTION

We found that when an intermediate layer comprising, incorporated in a binder, (A) phthalocyanine or phthalocyanine derivative and (B) a polycyclic aromatic nitro compound at a specific ratio is formed on an electrically conductive substrate and a top layer comprising (C) an organic polymeric photoconductor and (B) said polycyclic aromatic nitro compound at a specific ratio is formed on the intermediate layer, the dark decay speed of the resulting photosensitive material is controlled in a range suitable for application to the repeated copying operation and the residual potential can be reduced to a negligible level, whereby occurrence of fogging can be prevented, the toner transfer efficiency can be improved and the life of the photosensitive material can be prolonged. It also was found that a photosensitive material having this laminate structure is excellent in mechanical, chemical and electric durabilities.

More specifically, in accordance with this invention, there is provided a laminated photosensitive material for electrophotography, which comprises an electrically conductive substrate, an intermediate layer formed on the substrate and a top layer laminated on said intermediate layer, wherein the intermediate layer comprises, incorporated in a binder, (A) phthalocyanine or derivative and (B) a polycyclic aromatic nitro compound at an (A)/(B) mixing weight ratio of from 10/5 to 10/40 and the top layer comprises (C) an organic polymeric photoconductor and (B) said polycyclic aromatic nitro compound at a (C)/(B) mixing weight ratio of from 6/1 to 1/6.

DETAILED DESCRIPTION OF THE PREFERRED EMBODIMENTS

In this invention, as the phthalocyanine or phthalocyanine derivative (A) constituting the intermediate layer of the laminated photosensitive material, there can be used phthalocyanine and all of known phthalocyanine derivatives having photoconductivity, for example, aluminum phthalocyanine, aluminum polychlorophthalocyanine, antimony phthalocyanine, barium phthalocyanine, beryllium phthalocyanine, cadmium hexadecachlorophthalocyanine, cadmium phthalocyanine, cerium phthalocyanine, chromium phthalocyanine, cobalt phthalocyanine, cobalt chlorophthalocyanine, copper 4-aminophthalocyanine, copper bromochlorophthalocyanine, copper 4-chlorophthalocyanine, copper 4-nitrophthalocyanine, copper phthalocyanine, phthalocyanine sulfonate, copper polychlorophthalocyanine, deuterio phthalocyanine, dysprosium phthalocyanine, erbium phthalocyanine, europium phthalocyanine, gadolinium phthalocyanine, gallium phthalocyanine, germanium phthalocyanine, holmium phthalocyanine, indium phthalocyanine, iron phthalocyanine, iron polyhalophthalocyanine, lanthanum phthalocyanine, lead phthalocyanine, lead polychlorophthalocyanine, cobalt hexaphenylphthalocyanine, copper pentaphenylphthalocyanine, lithium phthalocyanine, ruthenium phthalocyanine,magnesium phthalocyanine, manganese phthalocyanine, mercury phthalocyanine, molybdenum phthalocyanine, neodium phthalocyanine, nickel phthalocyanine, nickel polyhalophthalocyanine, osmium phthalocyanine, palladium phthalocyanine, palladium chlorophthalocyanine, alkoxyphthalocyanine, alkylaminophthalocyanine, alkylmercaptophthalocyanine, aryloxyphthalocyanine, arylmercaptophthalocyanine, copper phthalocyanine piperidine, cycloalkylaminophthalocyanine, dialkylaminophthalocyanine,-diaralkylaminophthalocyanine, dicycloalkylaminophthalocyanine, hexadecahydrohphthalocyanine, imidomethylphthalocyanine, 1,2-naphthalocyanine, 2,3-naphthalocyanine, octa-azophthalocyanine, sulfur phthalocyanine, tetraazophthalocyanine, tetra-4-acetylaminophthalocyanine, tetra-4-aminobenzoylphthalocyanine, tetra-4-aminophthalocyanine, tetrachloromethylphthalocyanine, tetradiazophthalocyanine, tetra-4,4-dimethylocta-azophthalocyanine, tetra-4,5-diphenylene-oxide-phthalocyanine, tetra-4,5-diphenylocta-azophthalocyanine, tetra-(6-methylbenzothiazoyl)phthalocyanine, tetra-p-methylphenylaminophthalocyanine, tetramethylphthalocyanine, tetranaphthotriazolylphthalocyanine, tetra-4-naphthylphthalocyanine, tetra-4-nitrophthalocyanine, tetraperinaphthylene-4,5-octa-azophthalocyanine, tetra-2,3-phenylene-oxide-phthalocyanine, tetra-4-phenyloctaazophthalocyanine, tetraphenylphthalocyanine, tetraphenylphthalocyanine-tetracarboxylic acid, tetraphenylphthalocyanine tetrabariumcarboxylate, tetraphenylphthalocyanine-tetra-4-trifluoromethylmercaptophthalocyanine, tetrapyridine-phthalocyanine, tetra-4-trifluoromethylmercaptophthalocyanine, tetra-4-trifluoromethylphthalocyanine-4,5-thionaphtheneocta-azophthalocyanine, platinum phthalocyanine, potassium phthalocyanine, rhodium phthalocyanine, samarium phthalocyanine, silver phthalocyanine, silicon phthalocyanine, sodium phthalocyanine, sulfonated phthalocyanine, thorium phthalocyanine, thulium phthalocyanine, tin chlorophthalocyanine, tin phthalocyanine, titanium phthalocyanine, uranium phthalocyanine, vanadium phthalocyanine, ytteribium phthalocyanine, zinc chlorophthalocyanine, zinc phthalocyanine, and dimers, trimers, oligomers, polymers and copolymers thereof.

Phthalocyanine and phthalocyanine derivatives that are easily available and are especially suitable for attaining the objects of the present invention include metal-free phthalocyanine and their nuclear subtitution derivatives, for example, halogen-substituted derivatives.

In this invention, as the organic polymeric photoconductor (C) constituting the top layer, there can be used any of organic polymeric substances having photoconductivity, for example, poly-N-vinylcarbazole, poly-N-acrylphenothiazine, poly-N-(β-acryloxyethyl)-phenothiazine, poly-N-(2-acryloxypropyl)-phenothiazine, poly-N-allylcarbazole, poly-N-2-acryloxy-2-methyl-N-ethylcarbazole, poly-N-(2-p-vinylbenzoylethyl)-carbazole, poly-N-propenylcarbazole, poly-N-2-methylacryloxapropylcarbazole, poly-N-acrylcarbazole, poly-4-vinyl-p-(N-carbazyl)toluene, poly(-vinylanisolacetophenone), polyindene and other known photoconductive organic polymeric substances. Polymeric photoconductors that are easily available and are suitable for attainiing the objects of this invention include poly-N-vinylcarbazole and nuclear substitution derivatives thereof, for example, halogen- and alkyl-substituted derivatives.

As the polycyclic aromatic nitro compound to be combined with the phthalocyanine or phthalocyanine derivative (A) and the organic polymeric photoconductor (C) in the intermediate layer and top layer of the laminated photosensitive material of this invention, there can be used any of polycyclic aromatic compounds having at least one nitro group substituted on the nucleus, for example, 2,4-dinitro-1-chloronaphhtalene, 1,4-dinitronaphthalene, 1,5-dinitronaphthalene, 3-nitro-N-butylcarbazole, 4-nitrobiphenyl, 4,4'-dinitrobiphenyl, 1-chloro-4-nitroanthraquinone, 2,7-dinitroanthraquinone, 2,4,7-trinitrofluorenone, 2,4,5,7-tetranitrofluorenone, 9-dicyanomethylene-2,4,7-trinitrofluorenone and 4-nitroacenaphthene.

Polycyclic aromatic nitro compounds that are suitable for attaining the objects of this invention include trinitrofluoroenone and tetranitrofluorenone.

In the laminated photosensitive material of this invention, it is important that the phthalocyanine or phthalocyanine derivative (A) and the polycyclic aroatic nitro compound (B) should be incorporated in a binder at an (A)/(B) weight ratio of from 10/5 to 10/40, preferably from 10/7 to 10/14.

It is known that the phthalocyanine or phthalocyanine derivative (A) is used in combination with the polycyclic aromatic nitro compound (B) for an intermediate layer of a laminated photosensitive plate. In known photosensitive materials, however, the polycyclic aromatic compound is used in an amount much smaller than the amount specified in this invention. When the polycyclic aromatic nitro compound is used in an amount smaller than the amount specified in this invention, as will be apparent from Comparative Example 1 and Table 1 given hereinafter, the dark decay speed is too low and the residual potential is at a level that cannot be neglected. Therefore, in this photoconductive layer, fogging is readily caused at the high-speed repeated copying operation and the residual potential is accumulated, and since a large load is imposed on the photoconductive layer at the cleaning step, the resistance to the copying operation (the frequency of the repeated copying operation that the photosensitive material can resist) is drastically lowered. When the polycyclic aromatic compound is used in an amount larger than the amount specified in this invention, as will be apparent from Comparative Example 2 and Table 1 given hereinafter, the residual potential can be reduced substantially to zero, but the dark decay speed is too high and the primary surface potential (surface potential of the photosensitive material after charging but before exposure) is low, and it is difficult to obtain a copied image having high contrast and density. In contrast, if the mixing ratio of the polycyclic aromatic nitro compound to the phthalocyanine or phthalocyanine derivative is adjusted within the above-mentioned range according to this invention, at the high-speed repeated copying operation, the residual potential can be reduced to a negligible level while maintaining the primary surface potential at a high level, and the dark decay speed can be controlled so that the potential is abruptly lowered during a period ranging from the toner transfer step to the point of initiation of the cleaning operation. Therefore, according to this invention, it is possible to attain effects of improving the toner image transfer efficiency, facilitating the cleaning operation, preventing occurrence of fogging and improving the resistance to the copying operation concurrently.

This functional effect that when the polycyclic aromatic nitro compound is combined with the phthalocyanine or phthalocyanine derivative at the above-mentioned specific mixing ratio, the polycyclic aromatic nitro compound acts as a dark decay speed controlling agent for the phthalocyanine or phthalocyanine derivative is a novel effect found by use for the first time.

As the binder for dispersing therein the phthalocyanine or phthalocyanine derivative and the polycyclic aromatic nitro compound, there can be used any of known polymeric binders, especially electrically insulating binders. More specifically, there can be used, for example, acrylic resins such as polyacrylic acid esters, polymethacrylic acid esters, acrylic acid/methacrylic acid ester copolymers, acrylic acid/styrene copolymers and maleic anhydride/styrene/methacrylic acid ester copolymers, vinyl aromatic polymers such as polystyrene and poly-methylstyrene, vinyl chloride resins such as vinyl chloride/vinyl acetate copolymers, partially saponified vinyl chloride/vinyl acetate copolymers, partially saponified and acetalized vinyl chloride/vinyl acetate copolymers and vinyl chloride/vinyl acetate/-maleic anhydride copolymers, vinyl ester polymers such as polyvinyl acetate, butadiene copolymers such as styrene/butadiene copolymers and acrylonitrile/-styrene/butadiene copolymers, olefin resins such as ethylene/vinyl acetate copolymers, ethylene/acrylic acid copolymers and ionomers, polyester resins such as ethylene/butylene-terephthalate/isophthalate, polyamide and copolyamide resins, polycarbonate resins, unsaturated polyester resins, urethane resins such as acrylic urethane, epoxy resins, phenol-formaldehyde resins, xylene resins and melamine-formaldehyde resins. These binders may be used singly or in the form of a mixture of two or more of them. It is preferred that the electric resistance (volume resistivity) of the binder used be at least $1\times10^{11}$ Ω-cm. In order to attain the objects of this invention, it is especially preferred to use an acrylic resin as a binder.

The amount used of the binder is not particularly critical in this invention, but in general, it is preferred that the binder be used in an amount of 30 to 1000 parts by weight, especially 50 to 300 parts by weight, per 100 parts by weight of the phthalocyanine or phthalocyanine derivative (A).

In this invention, it is very important that a top layer comprising the above-mentioned organic polymeric photoconductor (C) and polycyclic aromatic nitro compound (B) at a specific mixing ratio should be laminated on the intermediate layer (first photoconductive layer) comprising the above-mentioned phthalocyanine or phthalocyanine derivative, polycyclic aromatic nitro compound and binder. More specifically, in case of a photosensitive plate formed by laminating a photoconductive layer comprising the above-mentioned phthalocyanine or phthalocyanine derivative, polycyclic aromatic nitro compound and binder in the form of a mono-layer on an electrically conductive substrate, as will be apparent from Comparative Example 3 and Table 1 given hereinafter, the primary surface potential (the surface potential of the photosensitive material after charging but before exposure) is considerably low, the rising speed of the surface potential is low and the sensitivity expressed by the half life (seconds) of light decay is considerably low. Thus, this comparative photosensitive material is still insufficient in various points. In contrast, when a layer (second photoconductive layer) comprising the above-mentioned organic polymeric photoconductor (C) and polycyclic aromatic nitro compound (B) is disposed on the intermediate layer (first photoconductive layer) formed on the electrically conductive substrate according to this invention, the foregoing properties can be remarkably improved without any bad influence on dark decay characteristics, which will readily be understood when results of Comparative Example 3 are compared with results of Examples of this invention.

It also is very important that in the top layer of the photosensitive material of this invention, the organic polymeric photoconductor (C) should be combined with the polycyclic aromatic nitro compound (B) at a (C)/(B) mixing weight ratio of from 6/1 to 1/6, especially from 1/1.7 to 1/2.2.

It is known that a polymeric photoconductor as an electron donor and a polycyclic aromatic nitro compound as an electron acceptor form a complex and a sensitized photoconductive layer can be formed from these two compounds. This invention is in agreement with this known technique in the point that a sensitized photoconductive layer is formed by using these two components. However, in this invention, not only from the viewpoint of the sensitivity but also from the viewpoints of the residual potential and the charge characteristics of the laminated photosensitive material, the above-mentioned specific mixing ratio of the polycyclic aromatic nitro compound to the polymeric photoconductor should be selected in this invention. This is one of important features of this invention. More specifically, when the amount of the polycyclic aromatic nitro compound incorporated in the top layer is smaller than the above amount specified in this invention, the sensitivity is reduced and further, as will be apparent from Comparative Example 5 and Table 1 given hereinafter, during the repeated copying operation the residual potential is accumulated on the surface of the photosensitive material, causing fogging, electric deterioration of the photoconductive layer and drastic reduction of the resistance to the copying operation. In contrast, when the amount of the polymeric photoconductor is larger than the amount specified in this invention, as will be apparent from Comparative Example 6 and Table 1 given hereinafter, the primary surface potential is drastically reduced and the rising speed of the surface potential is low. Accordingly, it is difficult to obtain satisfactory copied images. In contrast, when the organic polymeric photoconductor is combined with the polycyclic aromatic nitro compound at the above-mentioned specific weight ratio according to this invention, the charge characteristics of the surface of the photoconductive layer can be controlled so that the residual potential can be reduced to a level that can be neglected while elevating the primary surface potential and the speed of rising of the surface potential by charging to sufficiently high levels and bad influences owing to accumulation of the residual potential can be effectively eliminated.

In this invention, it is preferred that a silicone oil be incorporated in the top layer comprising the organic polymeric photoconductor and, the polycyclic aromatic nitro compound. We found that when a silicone oil is incorporated in the top layer, during the exposure and developing steps the dark decay speed can be maintained at a relatively low level and at the subsequent transfer or cleaning step the dark decay speed can be elevated at an extremely high level to thereby reduce drastically the residual potential on the non-exposed area. According to this preferred embodiment, accumulation of charges can be effectively prevented and there can be attained prominent effects of preventing occurrence of fogging, improving the toner transfer efficiency, preventing occurrence of insulation breakdown and improving the adaptability to the cleaning operation. Still further, in this preferred embodiment, the coating operation can be remarkably facilitated and the smoothness of the coating layer can be prominently improved.

As the silicone oil that can be used in this invention, there can be mentioned, for example, polydimethylsiloxane, polymethylphenylsiloxane, polyhydrodienemethylsiloxane, polymethylaminopropylsiloxane, their copolymers, and dimethylsiloxane/ethylene oxide block copolymers. Polydimethylsiloxane is especially preferred because it is easily available and is suitable for attaining the objects of this invention.

The amount incorporated of the silicone oil may be changed in a broad range, but in general, in order to attain the objects of this invention advantageously, it preferred that the silicone oil be incorporated in an amount of 1 to 30 parts by weight, especially 5 to 17 parts by weight, per 100 parts by weight of the organic polymeric photoconductor (C).

In this invention, a foil or plate of copper, aluminum, silver, tin or iron, which is formed into a sheet or drum, is used as the electrically conductive substrate. Further, a product formed by depositing such metal in the form of a thin film on a plastic film or the like by vacuum deposition, non-electrolytic plating or like means can be used as the electrically conductive substrate.

In general, the laminated photosensitive material of this invention is prepared by a process comprising coating a binder solution containing the phthalocyanine or phthalocyanine derivative (A) and the polycyclic aromatic nitro compound (B) at the above-mentioned specific ratio on an electrically conductive substrate such as mentioned above to form an intermediate layer, drying the so coated intermediate layer, coating a liquid composition comprising the organic polymeric photoconductor (C) and the polycyclic aromatic nitro compound (B) at the above-mentioned specific ratio on the intermediate layer, and drying the coating according to need.

As the solvent for preparing a coating composition for the intermediate layer, there can be used, for example, aromatic hydrocarbon solvents such as benzene, toluene and xylene, cyclic ethers such as dioxane and tetrahydrofuran, ketones such as acetone, methylethyl ketone, methylisobutyl ketone and cyclohexanone, alcohols such as diacetone alcohol and ethylene glycol isobutyl ether, and alicyclic hydrocarbons such as cyclohexane. These solvents may be used singly or in the form of a mixture of two or more of them.

In general, a coating composition for forming the intermediate layer is prepared by dissolving a binder such as mentioned above in one or more of the above-mentioned organic solvents, dispersing or dissolving the phthalocyanine or phthalocyanine derivative and the polycyclic aromatic nitro compound into the binder solution, and homogenizing the resulting dispersion or solution. From the viewpoint of the adaptability to the coating operation, it is generally preferred that the solid concentration of this coating composition be 1 to 80% by weight, especially 5 to 30% by weight.

A top layer-forming coating composition is prepared by dissolving the organic polymeric photoconductor (C) and polycyclic aromatic nitro compound (B) in one or more of the above-mentioned organic solvents to form a complex of the two components.

In general, it is preferred that this coating composition be applied to the intermediate layer at a solid concentration of 1 to 80% by weight, especially 5 to 30% by weight. The coated composition is ordinarily dried at a temperature of 10° to 180° C. to form a top layer.

In the above process, a complex is formed from the organic polymeric photoconductor (C) and the polycyclic aromatic nitro compound (B) in the coating solution. In this invention, it also is possible to adopt a process in which a solution of the organic polymeric photoconductor (C) and a solution of the polycyclic aromatic nitro compound (B) are prepared separately, the respective solutions are coated on the intermediate layer in this order or reverse order and a complex is formed directly on the intermediate layer.

In forming the top layer, it is preferred that the following be taken into consideration. Namely, it is preferred to select as the solvent of the top layer-forming coating composition a solvent that does not substantially dissolve the binder constituting the intermediate layer. Of course, it is permissible to use a solvent capable of substantially dissolving the intermediate layer for the top layer-forming coating composition. In this case, however, it is preferred that the top layer-forming composition be solidified within 5 minutes, especially 1 minute.

In the laminated photosensitive material of this invention, it is preferred that the thickness of the intermediate layer be 1 to 40μ, especially 3 to 6μ, and that the thickness of the top layer be 1 to 40μ, especially 3 to 7μ. If the thickness of the intermediate layer is smaller than 1μ, the primary surface potential or rising speed thereof is often too low, and if the thickness of the intermediate layer is larger than 40μ, the residual potential is at a level that cannot be neglected and occurrence of fogging or reduction of the resistance to the copying operation is readily caused. When the thickness of the top layer is smaller than 1μ, the primary surface potential or rising speed thereof is often too low, and when the thickness of the top layer is larger than 40μ, the sensitivity, i.e., the light decay speed, is reduced and insulation breakdown is readily caused.

In the laminated photosensitive material of this invention, as described hereinbefore, electric characteristics and photoconductive characteristics at the repeated copying operation can be remarkably improved, and furthermore, mechanical properties such as the peel resistance can be prominently improved. More specifically, although in case of a photosensitive material formed by applying a photoconductive layer comprising the above-mentioned phthalocyanine or phthalocyanine derivative, polycyclic aromatic nitro compound and binder in the form of a mono-layer to a metal substrate, the photoconductive layer is readily peeled off at a pressure-sensitive tape peel test described hereinafter, in case of the laminated photosensitive material of this invention, peeling of the photoconductive layer is not caused at all at the same test. Further, since the polymeric photoconductor is present on the surface layer, the abrasion resistance is enhanced. Thus, it will readily be understood that in the laminated photosensitive material of this invention, also the mechanical properties are remarkably improved.

The laminated photosensitive material of this invention is especially valuable and useful as a photosensitive material for an electrophotographic copying machine in which the surface of the photosensitive material is negatively charged and the photosensitive material is used repeatedly for the copying operation using all the rays in the visible region.

This invention will now be described in detail by reference to the following Examples that by no means limit the scope of the invention.

EXAMPLE 1

In 4.4 g of toluene were homogeneously dissolved 0.3 g of Phthalocyanine Blue (Heliogen Blue 7800 manufactured by BASF AG.), 0.3 g of 2,4,7-trinitro-9-fluorenone and 1.0 g of an acrylic resin (Paraloid A-21 manufactured by Rohm & Haas Co., solid content=30%), and the solution was coated on an aluminum plate so that the dry thickness of the coating was 5μ. Thus, an intermediate layer was formed.

In 190 g of tetrahydrofuran were homogeneously dissolved 10 g of poly-N-vinylcarbazole (hereinafter referred to as "PVK") (Luvican M170 manufactured by BASF AG.), 1 g of a silicone oil (KF 96 manufactured by Shinetsu Kagaku Kogyo K. K.) and 20 g of 2,4,7-trinitro-9-fluorenone, and the solution was coated as a top layer on the above phthalocyanine layer so that the dry thickness of the entire coating (inclusive of the phthalocyanine layer was 10μ. Thus, a photosensitive plate of the present invention was prepared.

The photosensitive plate obtained in Example 1 was tested by using a tester of the negative charging-exposure-developing-transfer-fixing type. Clear images having a high resolving power were obtained. Scores of thousands of prints could be obtained when the copying operation was repeated by using this photosensitive plate.

Electric characteristics of the photosensitive plate obtained in Example 1 were examined by using an electrostatic paper analyzer manufactured by Kawaguchi Denki K.K. to obtain results shown in Table 1.

EXAMPLE 2

In 7.8 g of methylethyl ketone were uniformly dispersed and dissolved 0.3 g of Phthalocyanine Blue (Heliogen Blue 7800 manufactured by BASF AG.), 0.3 g of 2,4,7-trinitro-9-fluorenone, 0.3 g of an epoxy resin (Epikote 1009 manufactured by Shell Chemical Co.) and 0.015 g of a curing agent (Epicure manufactured by Shell Chemical Co.), and the resulting composition was coated on an aluminum plate and dried at 180° C. in an oven for 30 minutes to thermally cure the epoxy resin. The thickness of the coating after curing was 5μ.

Then, 10 g of poly-N-vinylcarbazole (Tuvical 210 manufactured by Takasago Koryo K. K.), 1 g of a silicone oil (KF 96 manufactured by Shinetsu Kagaku Kogyo K. K.) and 20 g of 2,4,7-trinitro-9-fluorenone were homogeneously dissolved in 190 g of tetrahydrofuran, and the solution was coated on the phthalocyanine layer so that the dry thickness of the entire coating (inclusive of the phthalocyanine layer) was 10μ.

When this photosensitive plate was used for the photocopying operation in the same manner as described in Example 1, scores of thousands of clear prints having a high resolving power could be obtained.

EXAMPLE 3

In 5 g of toluene were homogeneously dispersed and dissolved 0.3 g of Phthalocyanine Blue (Heliogen Blue 7800 manufactured by BASF AG.), 0.3 g of 2,4,7-trinitro-9-fluorenone and 0.6 g of an unsaturated polyester resin (U-PICA AGS-260-A92 manufactured by Toyo Boseki K. K., solid content=50%), and the composition was coated on an aluminum plate and heated at 180° C. in an oven for 1 hour to thermally cure the unsaturated polyester resin. The thickness of the coating after curing was 5μ.

A PVK layer was laminated on the so formed phthalocyanine layer in the same manner as in Example 1. When the resulting photosensitive plate was tested in the same manner as described in Example 1, scores of thousands of clear prints could be obtained and the copied images had a very high resolving power.

EXAMPLE 4

In 6 g of toluene were homogeneously dispersed and dissolved 0.3 g of Phthalocyanine Blue (Heliogen Blue 7800 manufactured by BASF AG.), 0.3 g of 2,4,7-trinitro-9-fluorenone and 0.3 g of a polystyrene resin (D-150 manufactured by Esso Standard Petroleum K. K.), and the composition was coated on an aluminum plate so that the dry thickness of the coating was 5μ.

A PVK layer was laminated on this phthalocyanine layer in the same manner as described in Example 1. When the resulting photosensitive plate was tested in the same manner as described in Example, scores of thousands of clear prints could be obtained and copied images had a very high resolving power.

EXAMPLE 5

In 5 g of toluene were homogeneously dispersed and dissolved 0.3 g of Phthalocyanine Blue (Heliogen Blue 7800 manufactured by BASF AG.), 0.3 g of 2,4,7-trinitro-9-fluorenone and 0.6 g of a silicone resin (ES 1001 manufactured by Shinetsu Kagaku Kogyo K. K., solid content=50%), and the composition was coated on an aluminum plate so that the dry thickness of the coating was 5μ.

A PVK layer was laminated on this phthalocyanine layer in the same manner as described in Example 1. When the resulting photosensitive plate was tested in the same manner as described in Example 1, scores of thousands of clear prints could be obtained and copied images had a high resolving power.

EXAMPLE 6

In 3.4 g of toluene were homogeneously dispersed and dissolved 0.3 g of Phthalocyanine Blue (Heliogen Blue 7800 manufactured by BASF), 0.3 g of 2,4,7-trinitro-9-fluorenone and 5 g of an acrylic resin (Paraloid A-21 manufactured by Rhom & Haas Co.), and the composition was coated on an aluminum plate so that the dry thickness of the coating was 8μ.

Then, 10 g of polyvinylcarbazole (Luvican M170 manufactured by BASF AG.), 1 g of a silicone oil (KF 96 manufactured by Shinetsu Kogaku Kogyo K. K.) and 20 g of 2,4,7-trinitro-9-fluorenone were homogeneously dissolved in 190 g of tetrahydrofuran, and the solution was coated on the phthalocyanine layer so that the dry thickness of the entire coating (inclusive of the phthalocyanine layer) was 10μ.

When the so prepared photosensitive plate was tested in the same manner as described in Example 1 except that the polarity of charging was changed to the positive polarity, scores of thousands of clear prints could be obtained and copied images had a very high resolving power.

COMPARATIVE EXAMPLE 1

In 4.4 g of toluene were homogeneously dispersed and dissolved 0.3 g of Phthalocyanine Blue (Heliogen Blue 7800 manufactured by BASF AG.), 0.03 g of 2,4,7-trinitro-9-fluorenone and 1.0 g of an acrylic resin (Paraloid A-21 manufactured by Rhom & Haas Co., solid content=30%), and the composition was coated on an aluminum plate so that the dry thickness of the coating was 5μ.

Then, 10 g of poly-N-vinylcarbazole (Luvican M170 manufactured by BASF AG.), 1 g of a silicone oil (KF 96 manufactured by Shinetsu Kagaku Kogyo K. K.) and 20 g of 2,4,7-trinitro-9-fluorenone were homogeneously dissolved in 190 g of tetrahydrofuran. The resulting solution was coated as a top layer on the phthalocyanine layer so that the dry thickness of the entire coating (inclusive of the phthalocyanine layer) was 10μ. The resulting photosensitive plate were tested in the same manner as described in Example 1 to obtain results shown in Table 1.

Comparative Example 2

In 4.4 g of toluene were homogeneously dispersed and dissolved 0.3 g of Phthalocyanine Blue (Heliogen Blue 7800 manufactured by BASF AG.), 2.0 g of 2,4,7-trinitro-9-fluorenone and 1.0 g of an acrylic resin (Paraloid A-21 manufactured by Rhom & Haas Co.), and the composition was coated on an aluminum plate so that the dry thickness of the coating was 5μ.

In the same manner as described in Comparative Example 1, a top layer was formed on the so formed phthalocyanine layer. The resulting photosensitive plate was tested in the same manner as described in Example 1 to obtain results shown in Table 1.

Comparative Example 3

In 6 g of toluene were homogeneously dispersed and dissolved 0.3 g of Phthalocyanine Blue (Heliogen Blue 7800 manufactured by BASF AG.), 0.3 g of 2,4,7-trinitro-9-fluorenone and 3.5 g of an acrylic resin (FR-1112D manufactured Mitsubishi Kasei K. K., solid content =40%), and the composition was coated on an aluminum plate so that the dry thickness of the coating was 10μ.

The so obtained photosensitive plate was tested in the same manner as described in Example 1 except that the charging polarity was changed to the positive polarity. Obtained results are shown in Table 1.

Comparative Example 4

In 190 g of tetrahydrofuran were homogeneously dissolved 10 g of poly-N-vinylcarbazole (Luvican M170 manufactured by BASF AG.) and 20 g of 2,4,7-trinitro-9-fluorenone, and the solution was coated on an aluminum plate so that the dry thickness of the coating was 10μ.

The so obtained photosensitive plate was tested in the same manner as described in Example 1 to obtain results shown in Table 1.

Comparative Example 5

In 6 g of toluene were homogeneously dispersed and dissolved 0.3 g of Phthalocyanine Blue (Heliogen Blue 7800 manufactured by BASF AG.), 0.3 g of 2,4,7-trinitro-9-fluorenone and 0.3 g of a polystyrene resin (D-150 manufactured by Esso Standard Petroleum K. K.), and the composition was coated on an aluminum plate so that the dry thickness of the coating was 5μ. Thus, an intermediate layer was formed.

Then, 10 g of poly-N-vinyl carbazole (Luvican M170 manufactured by BASF AG.), 1 g of a silicone oil (KF 96 manufactured by Shinetsu Kagaku Kogyo K. K.) and 1 g of 2,4,7-trinitro-9-fluorenone were homogeneously dissolved in 190 g of tetrahydrofuran, and the solution was coated as a top layer on the phthalocyanine layer so that the dry thickness of the entire coating (inclusive of the phthalocyanine layer) was 10μ.

The so obtained photosensitive plate was tested in the same manner as described in Example 1 to obtain results shown in Table 1.

Comparative Example 6

In the same manner as described in Comparative Example 5, an intermediate layer having a thickness of 5μ was prepared then, 10 g of poly-N-vinylcarbazole (Luvican M170 manufactured by BASF AG.), 1 g of a silicone oil (KF 96 manufactured by Shinetsu Kagaku Kogyo K. K.) and 63 g of 2,4,7-trinitro-9-fluorenone were homogeneously dissolved in 190 g of tetrahydrofuran. The resulting solution was coated as a top layer on the phthalocyanine layer so that the dry thickness of the entire coating (inclusive of the phthalocyanine layer) was 10μ.

The so obtained photosensitive plate was tested in the same manner as described in Example 1 to obtain results shown in Table 1.

Table 1

| | Laminate Structure | | | | | Mono-Layer Structure | |
|---|---|---|---|---|---|---|---|
| | Example 1 | Comparative Example 1 | Comparative Example 2 | Comparative Example 5 | Comparative Example 6 | Comparative Example 3 | Comparative Example 4 |
| Copying Properties | | | | | | | |
| sharpness | O | X | X | Δ | Δ | X | O |
| density | O | O | X | O | X | Δ | Δ |
| fogging | O | X | O | X | O | Δ | Δ |
| cleaning property | O | X | O | Δ | O | Δ | Δ |
| resistance to printing operation | O | Δ | Δ | Δ | Δ | X | X |
| color image quality | O | O | O | O | O | X | O |
| transfer efficiency | O | X | O | Δ | O | Δ | Δ |
| Electric Characteristics | | | | | | | |
| sensitivity (Lux.sec) | 20 | 24 | 18 | 48 | 20 | 45 | 21 |
| initial potential (Volt) | 670 | 500 | 500 | 620 | 550 | 450 | 600 |
| charge quantity (Volt) | 720 | 550 | 540 | 730 | 600 | 560 | 670 |
| residual potential (Volt) | 0 | 60 | 0 | 120 | 0 | 30 | 15 |
| dark decay(Volt/sec) | 50 | 32 | 110 | 22 | 55 | 30 | 7.5 |
| Other | | | | | | | |
| adhesiveness | O | O | Δ | O | Δ | X | Δ |

Notes
Sharpness: Reproducibility of fine lines, meshes, half-tones and small letters, which was evaluated according to the following scale:
O: good Δ: slightly bad X: bad
Density: The density of the image area (non-exposed area), which was evaluated according to the following scale:
O: dense Δ: slightly thin X: thin
Fogging: Contamination of the background in the non-image area (exposure area), which was evaluated according to the following scale:
O: not observed Δ: slight X: conspicuous
Cleaning Property: Easiness in removing the toner left on the photosensitive plate after transfer, which was evaluated according to the following scale:
O: very easy Δ: slightly difficult X: difficult
Resistance to Copying Operation: The number of good quality prints obtained at the repeated copying operation, which was evaluated according to the following scale:
O: more than 20000 prints Δ: 1000–2000 prints X: less than 1000 prints
Color Image Quality: Reproducibility at printing of a color chart, which was evaluated according to the following scale:
O: good reproducibility X: no reproducibility (especially red)
Transfer Efficiency: The ratio of the toner transferred to copying paper after development, which was evaluated according to the following scale:
O: more than 80% of the toner was transferred Δ:50 to 80% of the toner was transferred X: less than 50% of the toner was transferred
Conditions for Measurements by Electrostatic Paper Analyzer:
Light: 40 Lux
Charge: 5 KV (negative) (positive in Comparative Example 3)
Sensitivity: quantity of light (Lux-sec) at which the potential just before exposure decayed to ½, which was determined according the static method
Initial potential: saturation charge voltage (V) as determined according to the static method
Charge quantity: saturation voltage (V) observed when charging was effected for 10 seconds, which was determined according to the dynamic method
Residual potential: voltage (V) observed 3 seconds after exposure, which was determined according to the static method
Dark decay: average value of the potential decay (V/sec) over a period of 3 seconds from charge-off, which was determined according to the static method
Adhesiveness: The adhesion strength of the photosensitive layer to the aluminum substrate (the peel resistance observedwhen an pressure-sensitive adhesive tape was applied to the photosensitive layer and the tape was then peeled off), which was evaluated according to the following scale:
O: strong Δ: ordinary X: weak

EXAMPLE 7

A photosensitive plate was prepared in the same manner as described in Example 1 except that 2,4,7-trinitro-9-fluorenone used in Example 1 was replaced by the same amount of 2,4,5,7-tetranitrofluorenone. When this photosensitive plate was tested in the same manner as described in Example 1, clear prints similar to these obtained in Example 1 were obtained with a high resistance to the copying operation.

Example 8

A photosensitive plate was prepared in the same manner as described in Example 1 except that Cyanine Blue BB (copper phthalocyanine manufactured by Dai-Nippon Ink K. K.) was used instead of Heliogen Blue 7800. When this photosensitive plate was tested in the same manner as described in Example 1, clear prints similar to those obtained in Example 1 were obtained with a high resistance to the copying operation.

Example 9

An intermediate layer was prepared in the same manner as described in Example 1. Then, 10 g of poly-N-vinylphenothiazine, 1 g of a silicone oil (KF 96 manufactured by Shinetsu Kagaku Kogyo K. K.) and 20 g of 2,4,7-trinitro-9-fluorenone were homogeneously dissolved in 190 g of tetrahydrofuran, and the solution was coated as a top layer on the intermediate phthalocyanine layer so that the dry thickness of the entire coating (inclusive of the phthalocyanine layer) was 10μ. When the so prepared photosensitive plate was tested in the same manner as in Example 1, clear prints could be obtained with a high resistance to the printing operation.

What we claim is:

1. A laminated photosensitive material for electrophotography, which comprises an electrically conductive substrate, an intermediate photoconductive layer formed on the substrate and a top photoconductive layer laminated on said intermediae layer, wherein the intermediate photoconductive layer comprises, incorporated in a binder, (A) phthalocyanine or a phthalocyanine derivative and (B) a polycrylic aromatic nitro compound selected from the group consisting of trinitrofluorenone and tetranitrofluorenone at an (A):(B) mixing weight ratio of from 10:5 to 10:40 and the top photoconductive layer comprises (C) polyvinyl carbazole or a nuclear substitution derivative thereof and said polycyclic aromatic nitro compound (B) at a (C):(B) mixing weight ratio of from 1:1.7 to 1:2.2

2. A laminated photosensitive material as set forth in claim 1 wherein the phthalocyanine or phthalocyanine derivative (A) is at least one member selecteed from the group consisting of metal free phthalocyanines and nuclear substitution derivatives thereof.

3. The laminated photosensitive material according to claim 2 wherein the binder is an acrylic resin, said top layer further comprises a silicone oil in an amount of 1:30 parts by weight per 100 parts by weight of the organic polymeric photoconductive (C) and said intermediate layer has a thickness of 1 to 40μ and the top layer has a thickness of 1 to 40μ.

4. The laminated photosensitive material as set forth in claim 3 wherein the mixing weight ratio of (A):(B) is from 10:7 to 10:14.

5. A laminated photosensitive material as set forth in claim 1 wherein the binder is an acrylic resin.

6. A laminated photosensitive material as set forth in claim 1 wherein the top layer further comprises a silicone oil in an amount of 1 to 30 parts by weight per 100 parts by weight of the organic polymeric photoconductor (C).

7. A laminated photosensitve material as set forth in claim 1 wherein the intermediate layer has a thickness of 1 to 40μ and the top layer has a thickness of 1 to 40μ.

* * * * *